United States Patent [19]

Arfert

[11] Patent Number: 4,516,383

[45] Date of Patent: May 14, 1985

[54] METHOD AND APPARATUS FOR PACKAGING CONTAINERS

[75] Inventor: Horst F. W. Arfert, Midlothian, Va.

[73] Assignee: Reynolds Metals Company, Richmond, Va.

[21] Appl. No.: 535,060

[22] Filed: Sep. 23, 1983

[51] Int. Cl.[3] ..... B65B 3/02

[52] U.S. Cl. ..... 53/410; 53/442; 53/381 R; 53/557

[58] Field of Search ..... 53/128, 381, 442, 410, 53/557

[56] References Cited

U.S. PATENT DOCUMENTS

| | | | |
|---|---|---|---|
| 332,903 | 12/1885 | Highfill . | |
| 1,045,932 | 12/1912 | Beckworth | 248/298 |
| 2,619,801 | 12/1952 | Evans | 62/1 |
| 3,196,021 | 7/1965 | Oas et al. | 99/192 |
| 3,338,404 | 8/1967 | Becker et al. | 206/65 |
| 3,387,702 | 6/1968 | Reynolds et al. | 206/65 |
| 3,399,546 | 9/1968 | Kuns et al. | 62/371 |
| 3,416,288 | 12/1968 | Coons | 53/27 |
| 3,675,767 | 7/1972 | Taylor | 206/655 |
| 3,922,362 | 11/1975 | Pierce | 53/442 X |
| 4,062,448 | 12/1977 | Meighan | 206/432 |
| 4,078,659 | 3/1978 | Rensner | 206/432 |

*Primary Examiner*—Paul A. Bell

*Attorney, Agent, or Firm*—Alan T. McDonald

[57] ABSTRACT

A method and apparatus are disclosed for packaging containers in cardboard trays with a surrounding plastics resin film. The trays are formed with apertures in each corner thereof, and holes are burned in the plastics resin film, after the package is formed, in registry with the apertures of the tray, permitting escape of leaked product within the containers from the package.

11 Claims, 3 Drawing Figures

METHOD AND APPARATUS FOR PACKAGING CONTAINERS

BACKGROUND OF THE INVENTION

Beverages, such as soft drinks and beer, are routinely contained in metallic cans. For shipment and storage of filled cans, it is common to package the filled cans in corrugated cardboard containers, typically containing 24 cans per container.

At first, corrugated cardboard cartons completely surrounding the cans were employed. More recently, however, in a cost reduction effort, the full corrugated carton has been replaced with a corrugated cardboard tray, which may extend, for example, approximately ½ the height of the cans held therein, with a heat shrinkable plastics resin film covering both the cans and the carton.

A problem inherent in the storage of the stacked cartons of filled metallic cans is the inevitable failure of one or more of these cans, causing leakage of the beverage contained therein. If the leaked beverage is held by the carton, the corrosive nature of the beverage often attacks other containers within that carton, in turn causing more failures. Eventually, there is a high probability of sufficient failures of adjacent cans such that collapse of these containers, due to the weight of cartons of containers stacked thereon results, leading to a catastrophic failure of a large portion of the stacked containers in, for example, a warehouse, common carrier vehicle, or the like.

The nature of the business is such that the beverage manufacturer relies on the can manufacturer to guarantee the quality of the cans, and looks to this can manufacturer should damage in transit or storage result. The can manufacturers, therefore, seek to minimize the damage that may result from defective "leaker" cans.

One way to minimize the danger of leakers, which was commonly employed when unwrapped cartons were employed to contain cans, was to form the cartons, as originally die cut from sheet stock, such that when folded, small openings resulted in each bottom corner of the carton. When such cartons were stacked, should a can leak, the beverage would not be held by the carton, resulting in the potential corrosion of adjacent cans, but would naturally tend to flow out of the carton through the openings, where it would evaporate, substantially reducing the change of corroding adjacent cans.

While this system was effective when fully surrounding cartons contained cans, the advent of plastic wrapped cardboard trays as containers for multiple cans covered any such holes which were formed in the cardboard tray, eliminating this potential source of beverage dissipation.

It would be desirable, therefore, to regain this effective means of dissipating leaked beverages from stacked cans, while at the same time maintaining the cost effectiveness of the plastic wrapped tray for metallic cans.

THE PRESENT INVENTION

By means of the present invention, this desired objective is obtained. According to the method of the present invention, plastic film wrapped trays of metallic cans are passed along a moving conveyor. During their conveyance along the conveyor, the front corners of each package contact heated members which quickly burn holes in the film at the corners of the film covering the carton. The front end of the package next reaches a raised roller, which lifts the package so that the package is no longer in contact with the heated surfaces. Finally, as the back end of the package passes the raised roller, the back corners of the package contact heated surfaces, again burning holes in the film, after which the package resumes its conveyance along the conveying surface.

The apparatus for accomplishing this result includes a driven conveyor mechanism which has as a portion thereof a raised roller and heated surfaces on either side of the raised roller against which the packages may be contacted prior to and subsequent to their passage over the raised roller.

BRIEF DESCRIPTION OF THE DRAWINGS

The method and apparatus of the present invention will be more fully described with reference to the drawings in which.

DETAILED DESCRIPTION OF THE PREFERRED EMBODIMENT

Figure 1:
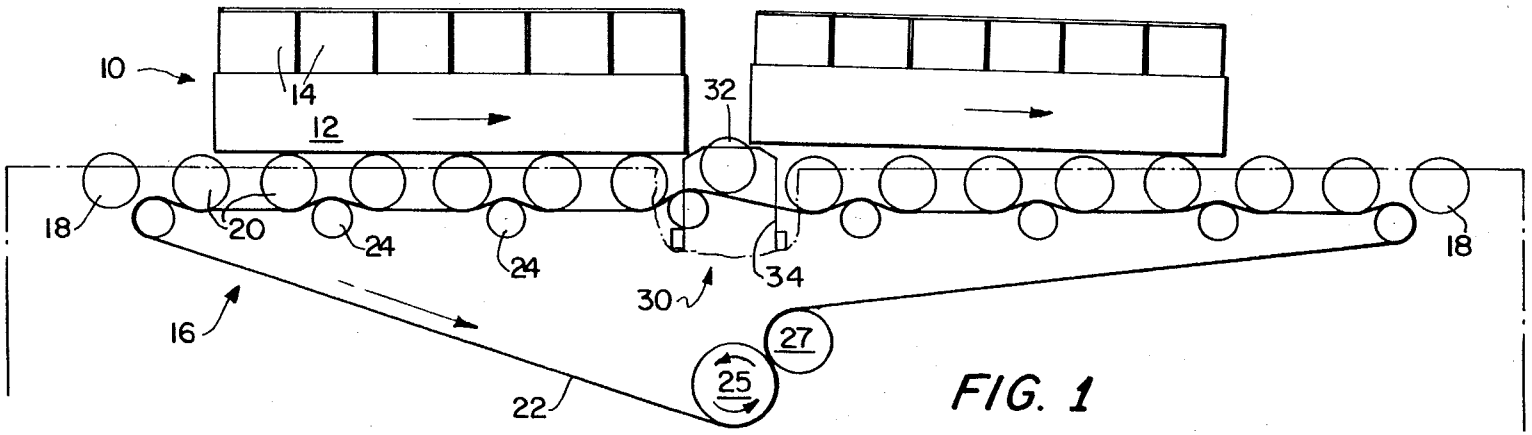
FIG. 1 is a side elevational view of a package conveying system employing the method and apparatus of the present invention.

Turning now to the FIGURES, in FIG. 1 packages 10 are being conveyed along a conveying mechanism 16. As illustrated, the packages 10 comprise metallic cans 14 packaged within cardboard trays 12 and wrapped by plastic film. While metallic cans 14 are illustrated, and reference has been previously made to metallic cans containing beverages therein, it should be clear that the containers 14 could be any containers which are prone to fluid leakage, such as bottles, jars, and the like.

The cardboard trays 12 are formed with apertures (not shown) in each bottom corner thereof, such as by die cutting carton blanks which, when folded into trays 12, produce the apertures in the corners of the trays 12.

Prior to their entry onto conveying mechanism 16, the packages 10 have been wrapped with a plastics resin film, preferably a heat shrinkable film, which would then be heat shrunk onto the package 10, again prior to its entry onto conveyor 16.

As illustrated, conveying mechanism 16 comprises idler rollers 18 at either end thereof and driven rollers 20. The driven rollers 20 are driven by means of a motorized drive roller 25, backup rolls 24 and 27, and belt 22. Although a belt driven system is illustrated, the driving mechanism for the conveyor is unimportant to the operation of the present invention. Thus, a chain driven, or other type conveying mechanism may be employed, or the conveying mechanism could be an undriven and inclined conveying mechanism.

As it passes along conveying mechanism 16, package 10 eventually reaches heater mechanism 30. The front bottom corners of package 10 contact heated surfaces 36 of the heater mechanism 30. The surfaces 36 are heated to a temperature sufficient to burn the plastic film covering package 10, such as about 380° F. (193° C.). This quickly burns holes into the corners of the film covering package 10, in registry with the apertures formed in tray 12.

As the package 10 continues, it rides over raised roller 32. Raised roller 32 lifts the package 10 from heated surface 36, so that the plastic film covering the bottom of the package 10 is not burned. The height of roller 32 with respect to rollers 20 will vary, based upon the size of the packages 10 being passed thereover. Typically, for a tray containing 24 beverage cans, this height may range from about 0.25 to 0.50 inches (0.64 to 1.27 centimeters). Finally, as the back end of package 10 exits raised roller 32, the bottom corners thereof contact heated surfaces 38, burning holes in the plastic film covering the apertures formed in the tray 12 in these corners. The now appatured package 10 completes its movement along conveyor mechanism 16 to its destination.

Figure 2:
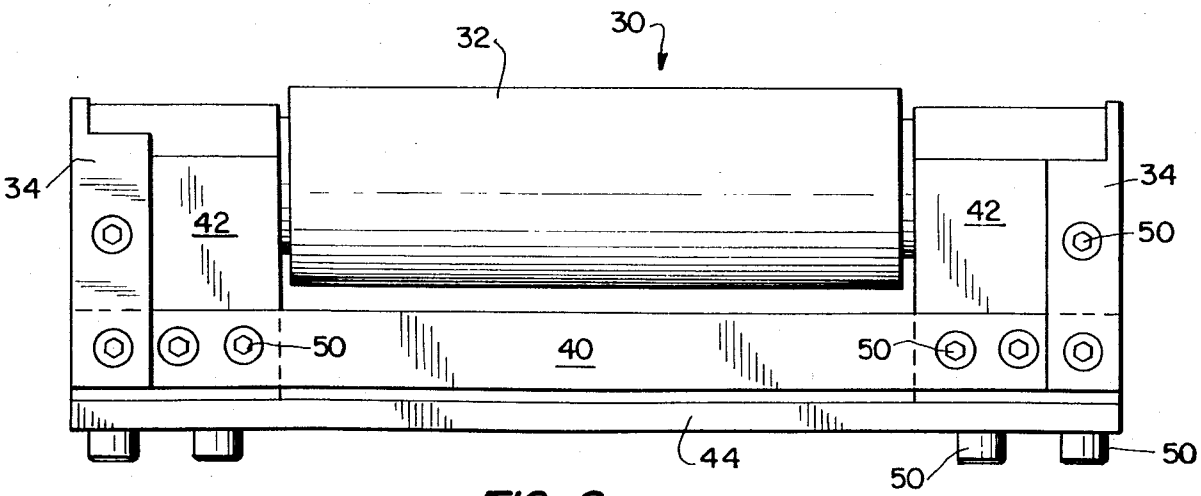
FIG. 2 is a front elevational view of a heater mechanism according to the present invention.
Figure 3:
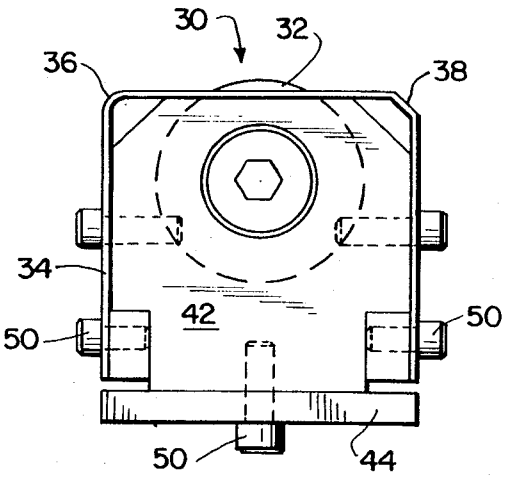
FIG. 3 is a side elevational view of the heater mechanism.

FIGS. 2 and 3 illustrate the heater mechanism 30. A roller 32 is mounted between a pair of mounting plates 42. Mounted on to the opposite ends of mounting plates 42 are a pair of heater plates 34. These heater plates 34 are also mounted to a heater bar 40.

The assembly is carried on a support plate 44 and is held together by means of a plurality of screws 50.

Heater plates 34 are formed of an electrically conductive metal, such as brass, copper, or stainless steel, as is heater bar 40. Heater bar 40 is connected to a source of electrical energy (not shown) and, when electrical current is supplied, it, along with heater plates 34, are heated to a temperature sufficient to burn the plastics resin film, as previously described. Mounting plates 42 are formed from an electrically nonconductive material which is a heat dissipator, such as a phenolic resin. Roller 32 may be formed of any desired material, such as steel, aluminum, rubber, or a thermosetting plastic.

As is readily apparent, when employing the method and apparatus of the present invention, the packages treated thereby will have apertures in each corner thereof, permitting any leaked material contained therein to escape and evaporate, substantially reducing the chances for a catastrophic failure during warehousing or transit.

While the invention has been described with reference to certain specific embodiments, it is not intended to be so limited thereby, except as set forth in the accompanying claims.

I claim:

1. In a method of packaging containers comprising placing said containers in a tray, said tray having apertures in the bottom corners thereof, and wrapping said tray with a plastic film to form a unitary package the improvement comprising passing said package along a conveyor, contacting the front bottom corners of said package with heated surfaces to burn apertures in said film in registry with said apertures in the front bottom corners of said tray, passing said package over said heated surfaces and contacting the rear bottom corners of said package with said heated surfaces to burn apertures in said film in registry with said apertures in the rear bottom corners of said tray.

2. The method of claim 1 wherein said tray is formed from cardboard.

3. The method of claim 1 wherein said plastic film is a heat shrinkable film and wherein said plastic film is heat shrunk to form said package prior to said contacting of said plastic film with said heated surfaces.

4. The method of claim 1 wherein said containers are metallic cans.

5. In an apparatus for conveying plastic film wrapped packages comprising a conveying surface the improvement comprising a heater means for forming aperatures in said plastics film comprising a pair of surfaces for contacting the bottom corners of said packages, means for lifting said packages over said surfaces and means for heating said surfaces.

6. The apparatus of claim 5 wherein said means for lifting comprises a roller.

7. The apparatus of claim 6 wherein said roller is formed from steel, aluminum, rubber or a thermosetting plastic.

8. The apparatus of claim 5 wherein said heated surfaces are heater plates.

9. The apparatus of claim 7 wherein said heater plates are formed from brass, copper or stainless steel.

10. The apparatus of claim 5 wherein said means for heating comprises a heater bar electrically connected to said surfaces and means for supplying electrical energy to said heater bar.

11. The apparatus of claim 5 wherein said conveying surface comprises a driven roller conveyor.

* * * * *